US009662710B2

(12) United States Patent
Koo et al.

(10) Patent No.: US 9,662,710 B2
(45) Date of Patent: May 30, 2017

(54) METHOD OF MANUFACTURING SILVER NANOWIRES

(71) Applicants: Samsung Display Co., Ltd., Yongin (KR); Korea Advanced Institute of Science and Technology, Daejeon (KR)

(72) Inventors: Hyun-Woo Koo, Yongin (KR); Tae-Woong Kim, Yongin (KR); Jung-Yong Lee, Daejeon (KR); Jaemin Lee, Daejeon (KR); Seonju Jeong, Daejeon (KR)

(73) Assignee: Samsung Display Co., Ltd.

( * ) Notice: Subject to any disclaimer, the term of this patent is extended or adjusted under 35 U.S.C. 154(b) by 405 days.

(21) Appl. No.: 14/196,576

(22) Filed: Mar. 4, 2014

(65) Prior Publication Data

US 2015/0047468 A1 Feb. 19, 2015

(30) Foreign Application Priority Data

Aug. 14, 2013 (KR) ..... 10-2013-0096902

(51) Int. Cl.
*B22F 9/24* (2006.01)
*B22F 1/00* (2006.01)
*C22C 5/06* (2006.01)

(52) U.S. Cl.
CPC ..... *B22F 9/24* (2013.01); *B22F 1/0025* (2013.01); *C22C 5/06* (2013.01); *B22F 2301/255* (2013.01); *B22F 2304/054* (2013.01)

(58) Field of Classification Search
CPC ..... B22F 9/24; B22F 1/0025; B22F 2301/255
See application file for complete search history.

(56) References Cited

U.S. PATENT DOCUMENTS

2007/0034052 A1 2/2007 Vanheusden et al.
2009/0196788 A1 8/2009 Wang et al.
2009/0242231 A1 10/2009 Miyagisima et al.
(Continued)

FOREIGN PATENT DOCUMENTS

JP 2009-0242880 10/2009
KR 10-2009-0026500 3/2009
(Continued)

OTHER PUBLICATIONS

Lee, et al., "Highly Stretchable and Highly Conductive Metal Electrode by Very Long Metal Nanowire Percolation Network", Advanced Materials, 2012, pp. 3326-3332, vol. 24, WILEY-VCH Verlag GmbH & Co. KGaA, Weinheim.
(Continued)

*Primary Examiner* — Colleen Dunn
(74) *Attorney, Agent, or Firm* — H.C. Park & Associates, PLC

(57) ABSTRACT

A method of manufacturing silver nanowires includes: forming a first solution including a dispersion stabilizer and a polyol; forming a second solution including a dispersion stabilizer, a silver precursor, a halogen-ion donor, deionized water, and the polyol; forming a third solution by adding the second solution to the first solution; heating the third solution from a first temperature to a second temperature; and forming silver nanowires by maintaining the third solution at the second temperature.

18 Claims, 4 Drawing Sheets

(56) References Cited

U.S. PATENT DOCUMENTS

| | | | | |
|---|---|---|---|---|
| 2011/0185853 | A1* | 8/2011 | Wang | B22F 9/24 75/371 |
| 2012/0247275 | A1 | 10/2012 | Yang et al. | |

FOREIGN PATENT DOCUMENTS

| | | |
|---|---|---|
| KR | 10-2010-0085383 | 7/2010 |
| KR | 10-2011-0071526 | 6/2011 |
| KR | 10-2012-0129451 | 11/2012 |
| WO | 2007/001453 | 1/2007 |

OTHER PUBLICATIONS

Yang, et al., "Silver Nanowires: From Scalable Synthesis to Recyclable Foldable Electronics", Advanced Materials, 2011, pp. 3052-3056, vol. 23, WILEY-VCH Verlag GmbH & Co. KGaA, Weinheim.

Yang, et al., "Solution-Processed Flexible Polymer Solar Cells with Silver Nanowire Electrodes", ACS Applied Materials & Interfaces, 2011 American Chemical Society, Sep. 7, 2011, pp. 4075-4084, vol. 3, ACS Publications.

Liu, et al., "Silver Nonowire-Based Transparent, Flexible, and Conductive Thin Film", Nanoscale Research Letters 2011, http://www.nanoscalerslett.com/content/6/1/75, pp. 1-8, Department of Mechanical and Industrial Engineering, University of Minnesota Duluth, Duluth, MN 55812, USA.

Bergin, et al., "The effect of Nanowire Length and Diameter on the Properties of Transparent, Conducting Nanowire Films", Nanoscale, 2012, 4, 1996, www.rsc.org/nanoscale, Feb. 8, 2012, The Royal Society of Chemistry 2012.

* cited by examiner

METHOD OF MANUFACTURING SILVER NANOWIRES

CROSS REFERENCE TO RELATED APPLICATION

This application claims priority from and the benefit of Korean Patent Application No. 10-2013-0096902, filed on Aug. 14, 2013, the disclosure of which is incorporated by reference for all purposes as if fully set forth herein.

BACKGROUND

Field

One or more embodiments of the present invention relate to a method of manufacturing silver nanowires.

Discussion of the Background

A single-crystal metal nanowire has high chemical stability, high thermal conductivity, and high electrical conductivity. Thus, a single-crystal metal nanowire is very useful in electrical, magnetic, and optical devices and sensors.

Specifically, among all metals, silver (Ag) has the best electrical and thermal conductivity. Optical characteristics of Ag are so good that Ag has the highest surface-enhanced Raman effect in a visible ray region.

When Ag is manufactured in the form of a nanowire, applications of silver nanowire, such as a microelectronic device, a transparent electrode, and the like, may be developed, and the use of silver nanowire as an optical, chemical, or bio sensor is also expected. However, to use the silver nanowire in various fields, a method is needed to manufacture a nanowire having a short processing time, a low processing temperature, and a high aspect ratio.

SUMMARY

One or more embodiments of the present invention include a method of manufacturing silver nanowires having a high aspect ratio.

Additional aspects of the present disclosure will be set forth in part in the description which follows and, in part, will be apparent from the description, or may be learned by practice of the presented embodiments.

According to one or more embodiments of the present invention, a method of manufacturing silver nanowires includes: forming a first solution by adding a dispersion stabilizer to a first polyol; stirring the first solution; forming a second solution by adding a dispersion stabilizer, a silver precursor, a halogen-ion donor, and deionized water to a second polyol; forming a third solution by adding the second solution to the first solution; heating the third solution from a first temperature to a second temperature; and forming silver nanowires by maintaining the third solution at the second temperature.

According to one or more embodiments of the present invention, a method of manufacturing silver nanowires includes: forming a first solution by dissolving a dispersion stabilizer in a first polyol and cooling the first solution to a first temperature; forming a second solution by adding a dispersion stabilizer, a silver precursor, a halogen-ion donor, and deionized water to a second polyol; adding the second solution to the first solution and reacting the first solution having the second solution added thereto by increasing the temperature of the first solution having the second solution added thereto from the first temperature to a second temperature; and forming silver nanowires by reacting the first solution having the second solution added thereto for a first time at the second temperature.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate exemplary embodiments of the invention, and together with the description serve to explain the principles of the invention.

DETAILED DESCRIPTION OF THE ILLUSTRATED EMBODIMENTS

Figure 1:
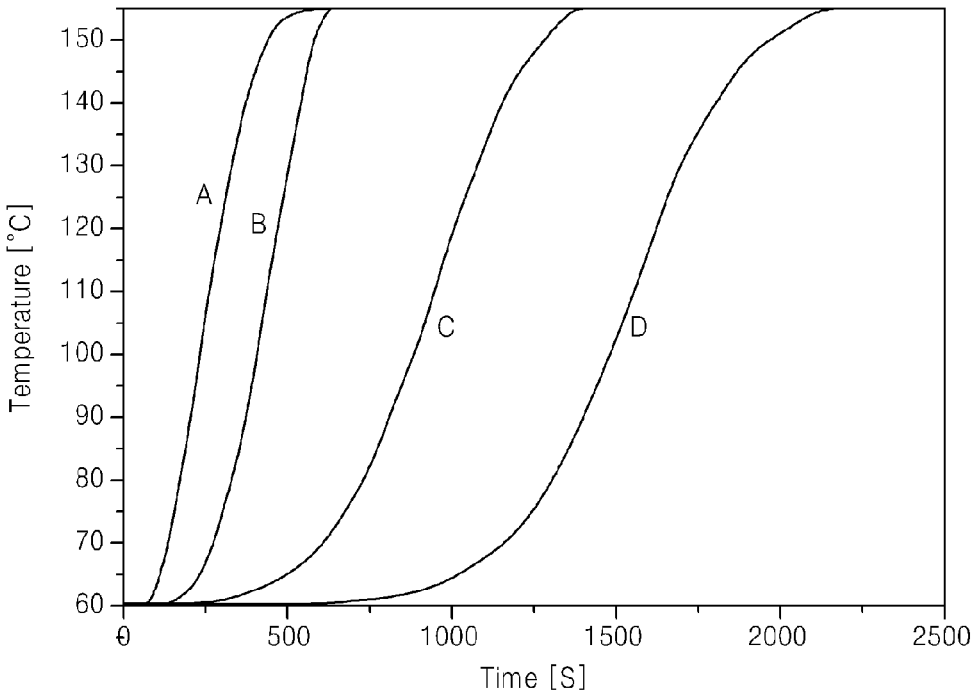
FIG. 1 is a graph showing changes in a temperature according to time for silver nanowires manufactured according to first to seventh embodiments of the present invention.

The invention is described more fully hereinafter with reference to the accompanying drawings, in which exemplary embodiments of the invention are shown. This invention may, however, be embodied in many different forms and should not be construed as limited to the exemplary embodiments set forth herein. Rather, these exemplary embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that although the terms "first", "second", etc. may be used herein to describe various components, these components should not be limited by these terms. These components are only used to distinguish one component from another.

As used herein, the singular forms "a," "an" and "the" are intended to include the plural forms as well, unless the context clearly indicates otherwise. It will be further understood that the terms "comprises" and/or "comprising" used herein specify the presence of stated features or components, but do not preclude the presence or addition of one or more other features or components.

It will be understood that when an element or layer is referred to as being "on" or "connected to" another element or layer, it can be directly on or directly connected to the other element or layer, or intervening elements or layers may be present. In contrast, when an element referred to as being "directly on" or "directly connected to" another element or layer, there are no intervening elements or layers present. It will be understood that for the purposes of this disclosure, "at least one of X, Y, and Z" can be construed as X only, Y only, Z only, or any combination of two or more items X, Y, and Z (e.g., XYZ, XYY, YZ, ZZ).

According to aspects of the present invention, a composition for manufacturing silver nanowires, which includes a polyol, a dispersion stabilizer, a silver precursor, a halogen-ion donor, and deionized water, is provided.

Aspects of the present invention relate to a method of manufacturing silver nanowires is provided that comprises: forming a first solution by dissolving a dispersion stabilizer in a polyol; cooling the first solution to a first temperature; forming a second solution by adding a dispersion stabilizer, a silver precursor, a halogen-ion donor, and deionized water, to another amount of the polyol; forming a third solution by adding the second solution to the first solution; increasing the temperature of the third solution from the first temperature to a second temperature; and forming silver nanowires by maintaining the third solution at the second temperature, for a first time period.

The first solution may be formed by dissolving the dispersion stabilizer in the polyol by stirring at about 90° C. to about 110° C. However, the present invention is not limited thereto.

The first temperature may be about 50° C. to about 60° C., and the second temperature may be about 145° C. to about 170° C. However, the present invention is not limited thereto. The first time period, during which the temperature of the third solution is increased from the first temperature to the second temperature, may be, for example, about 10 minutes to about 40 minutes, but the present invention is not limited thereto. The first time period may be about 10 minutes to about 30 minutes, for example.

The method may further include filtering the silver nanowires from the third solution. The filtering may include selectively filtering silver nanowires of a specific size from the third solution.

The polyol operates to reduce the silver precursor into a silver metal. The polyol also operates as a solvent for dissolving the silver precursor. The polyol may be referred to as a polyfunctional alcohol having two or more hydroxyl radicals (—OH). For example, the polyol may be an ether polyol and/or an ester polyol. The ether polyol may be manufactured by adding propylene oxide (PO) or ethylene oxide (EO) to an initiator having two or more activated hydrogens (—OH, $NH_2$). The ester polyol may be manufactured by dehydrating and polymerizing a polyfunctional alcohol having two or more hydroxyl radicals, which is added to a polybasic acid. The polyol includes a glycol and a diol having two hydroxyl radicals. The polyol may include at least one of a diethylene glycol obtained by etherizing ethylene glycol or propylene glycol, dipropylene glycol, polyethylene glycol, a glycerol having three hydroxyl radicals, and a pentaerythritol having four hydroxyl radicals. However, the present invention is not limited thereto.

The dispersion stabilizer is not specially limited, and may be at least one of a water-soluble polymer, such as polyvinyl pyrrolidone (PVP), polyvinyl alcohol (PVA), polyacrylamide, polyacrylic acid, poly(diallyldimethylammonium chloride) (PDADMAC), dextrin, or the like. However, the present invention is not limited thereto.

At least on of silver nitrate, silver acetate, silver chloride, silver bromide, silver iodide, or silver fluoride may be used as the silver precursor. In the exemplary embodiments of the present invention, silver nitrate is used as the silver precursor. However, the present invention is not limited thereto.

Representative and unlimited examples of the halogen-ion donor are sodium chloride (NaCl), sodium bromide (NaBr), potassium chloride (KCl), potassium bromide (KBr), ammonium chloride ($NH_4Cl$), and zinc chloride ($ZnCl_2$). Each halogen-ion donor may be used alone, or two or more halogen-ion donors may be mixed and used. However, the present invention is not limited thereto.

Since the silver nanowires manufactured according to embodiments of the present invention have a high aspect ratio. The silver nanowires may have good mechanical characteristics and may be used for electrodes, sensors, heating films, and transparent conductive films. However, the present invention is not limited thereto. Since silver nanowires may be produced with a reduced amount of processing time, in a low-temperature process, the silver nanowires may be simply and cheaply manufactured, according to various embodiments.

Methods of manufacturing silver nanowires according to the present invention will be described in more detail with reference to the exemplary embodiments below. The exemplary embodiments below are only provided to describe the present disclosure, and the present disclosure is not limited to the exemplary embodiments below.

First Embodiment

Forming First Solution

The first solution was formed by adding 263 μM of PVP (M.W. 55000) to 190 mL of glycerol, followed by stirring for about one hour, at about 90° C. to about 110° C., until the PVP dissolved.

After moving the first solution into a two-hole flask, the first solution was cooled to about 50° C. to about 60° C.

Forming Second Solution

The second solution of 10 mL was manufactured by adding 46.5 μM of silver nitrate ($AgNO_3$), 12 μM of NaCl, and 0.5 mL of pure (distilled) water to glycerol.

Forming Third Solution

The third solution was formed by adding the second solution to the two-hole flask containing the first solution.

Manufacturing Silver Nanowires

FIG. 1 is a graph showing temperature changes according to time for third solutions manufactured according to first to seventh embodiments of the present invention. In particular, the third solution of the First Embodiment was heated over a period of about 600 seconds, from about 55° C. to about 155° C., along curve A of FIG. 1.

Thereafter, silver nanowires were manufactured by leaving the third solution in the two-hole flask for about 10 minutes, at about 155° C.

Figure 2:
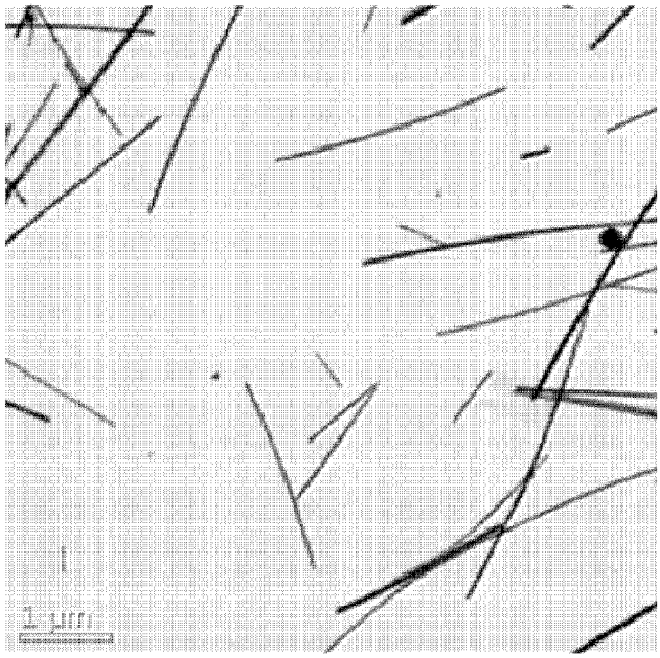
FIGS. 2 and 3 illustrate scanning electron microscope (SEM) images of silver nanowires manufactured according to the first embodiment.
Figure 3:
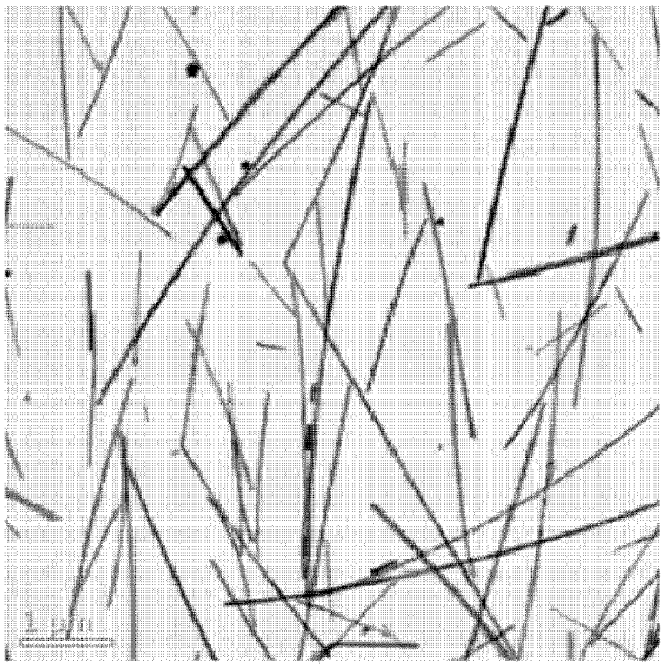

An average diameter of the manufactured silver nanowires was about 60 nm, and an average length thereof was about 10 μm. FIGS. 2 and 3 illustrate scanning electron microscope (SEM) images of the silver nanowires manufactured according to the First Embodiment, wherein an average length of the manufactured silver nanowires is 10 μm or less.

Second Embodiment

Forming First Solution

The first solution was formed under the same conditions and method as the First Embodiment.

Forming Second Solution

The second solution was formed under the same conditions and method as the First Embodiment.

Forming Third Solution

The third solution was formed by adding the second solution to the two-hole flask containing the first solution.

Manufacturing Silver Nanowires

The third solution was heated along curve B of FIG. 1, in the Second Embodiment. In more detail, the third solution was heated from about 55° C. to about 155° C., over a period of about 600 seconds.

Thereafter, silver nanowires were manufactured by leaving the third solution in the two-hole flask for about 10 minutes, at about 155° C. Thereafter, a polar organic solvent, such as pure water, isopropanol (IPA), methanol, acetone, or the like, was mixed with the third solution containing the silver nanowires.

Figure 4:
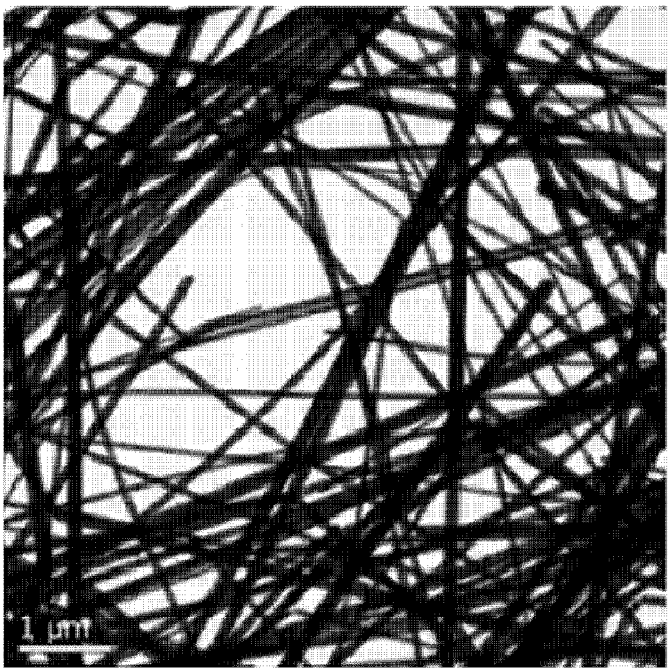
FIGS. 4 and 5 illustrate SEM images of silver nanowires manufactured according to the second embodiment.
Figure 5:
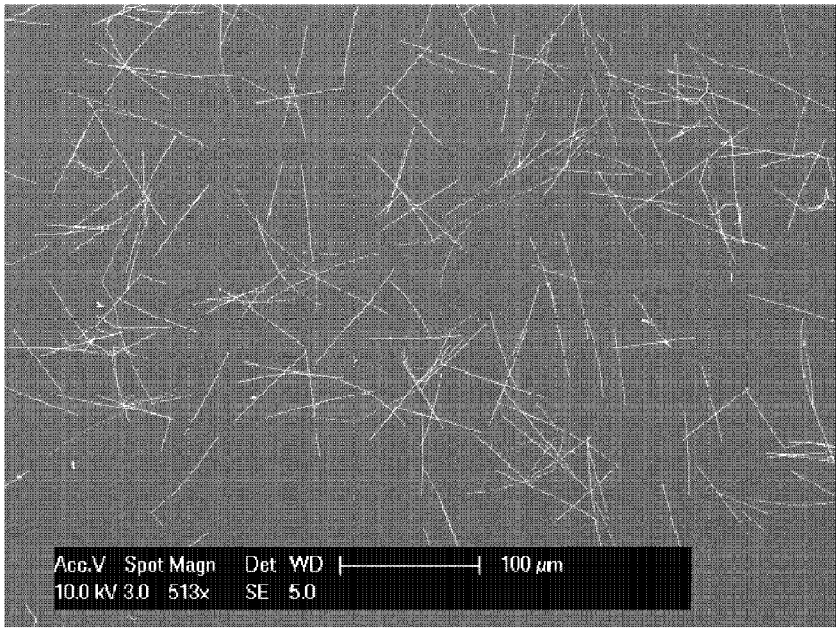

Thereafter, the silver nanowires of a predetermined size were selectively filtered using a vacuum pump with a glass filter funnel having pores sized from about 10 μm to about 16 μm, or from about 16 μm to about 40 μm. An average diameter of the manufactured silver nanowires which remained after the filtering was about 80 nm, and an average length thereof was about 20 μm to about 50 μm. FIGS. 4 and 5 illustrate SEM images of the silver nanowires manufactured according to the Second Embodiment, wherein an average length of the manufactured silver nanowires is about 42 μm.

Third Embodiment

Forming First Solution

The first solution was formed under the same conditions and method as the First Embodiment.

Forming Second Solution

The second solution was formed under the same conditions and method as the First Embodiment.

Forming Third Solution

The third solution was formed by adding the second solution to the two-hole flask containing the first solution.

Manufacturing Silver Nanowires

The third solution was heated along curve C of FIG. 1, in the Third Embodiment. In more detail, the third solution was heated for about 1350 seconds, from about 55° C. to about 155° C.

Thereafter, the third solution was left in the two-hole flask for about 10 minutes at about 155° C. Thereafter, a polar organic solvent, such as pure water, IPA, methanol, acetone, or the like, was mixed with the third solution. Thereafter, silver nanowires were selectively filtered using a vacuum pump with a glass filter funnel of which a pore size was about 10 μm to about 16 μm, or about 16 μm to about 40 μm.

Figure 6:
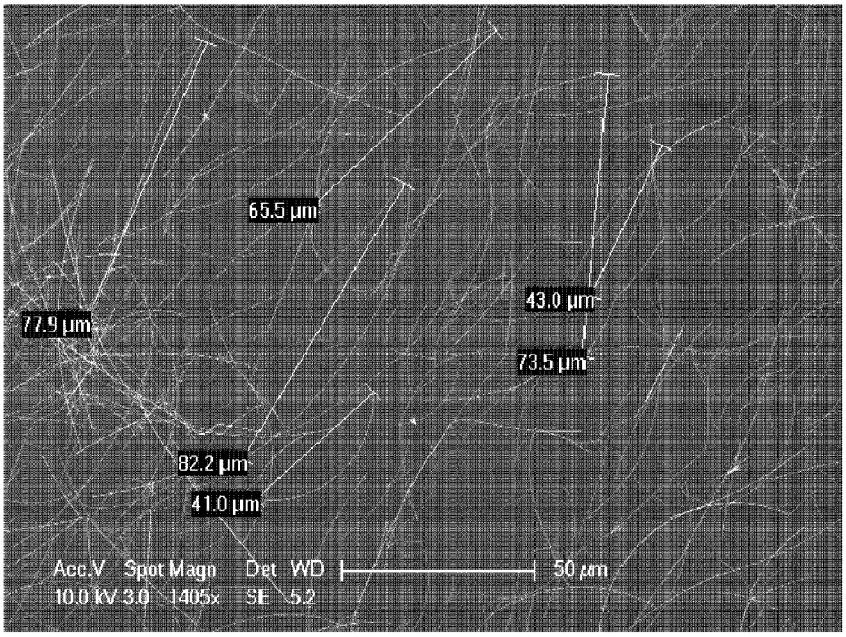
FIG. 6 illustrates an SEM image of silver nanowires manufactured according to the third embodiment.

An average diameter of the manufactured and filtered silver nanowires was about 50 nm, and an average length thereof was about 50 μm to about 80 μm. FIG. 6 illustrates an SEM image of the silver nanowires manufactured according to the Third Embodiment, wherein an average length of the manufactured silver nanowires is about 72 μm.

Fourth Embodiment

Forming First Solution

The first solution was formed under the same conditions and method as the First Embodiment.

Forming Second Solution

The second solution was formed under the same conditions and method as the First Embodiment.

Forming Third Solution

The third solution was formed by adding the second solution to the two-hole flask containing the first solution.

Manufacturing Silver Nanowires

The third solution was heated along curve D of FIG. 1, in the Fourth Embodiment. In more detail, the third solution is heated for about 2200 seconds from about 55° C. to about 155° C.

Thereafter, the third solution was left in the two-hole flask for about 10 minutes at about 155° C. Thereafter, a polar organic solvent, such as pure water, IPA, methanol, acetone, or the like, was mixed with the third solution. Thereafter, silver nanowires were selectively filtered using a vacuum pump with a glass filter funnel of which a pore size was about 10 μm to about 16 μm, or about 16 μm to about 40 μm.

Figure 7:
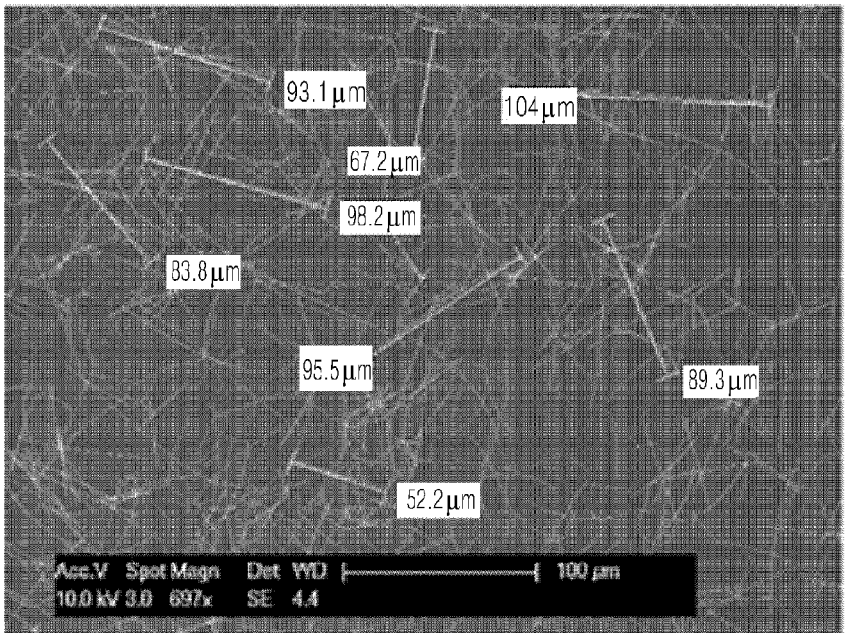
FIG. 7 illustrates an SEM image of silver nanowires manufactured according to the fourth embodiment.

An average diameter of the manufactured and filtered silver nanowires was about 80 nm, and an average length thereof was about 80 μm to about 100 μm. FIG. 7 illustrates an SEM image of the silver nanowires manufactured according to the Fourth Embodiment, wherein an average length of the manufactured silver nanowires is about 100 μm.

According to the First to Fourth Embodiments, silver nanowires having different sizes may be manufactured by changing a temperature curve for heating the third solutions.

Fifth Embodiment

Forming First Solution

The first solution was formed by adding 347.9 μM of PVP (M.W. 55000) to 190 mL of glycerol, then stirring for about one hour, at about 100° C., until the PVP dissolved. After moving the first solution into a two-hole flask, the first solution was cooled to about 55° C.

Forming Second Solution

The second solution of 10 mL was manufactured by adding 46.5 μM of $AgNO_3$, 12 μM of NaCl, and 0.5 mL of pure water to glycerol.

Forming Third Solution

The third solution was formed by adding the second solution to the two-hole flask containing the first solution.

Manufacturing Silver Nanowires

The third solution was heated from about 55° C. to about 155° C., along curve D of FIG. 1. Thereafter, the third solution was left in the two-hole flask for about 10 minutes, at about 155° C. Thereafter, a polar organic solvent, such as pure water, IPA, methanol, acetone, or the like, was mixed with the third solution.

Thereafter, silver nanowires were selectively filtered using a vacuum pump with a glass filter funnel of which a pore size was about 10 μm to about 16 μm, or about 16 μm to about 40 μm. An average diameter of the manufactured and filtered silver nanowires was about 40 nm to about 70 nm, and an average length thereof was about 40 μm to about 80 μm.

Sixth Embodiment

Forming First Solution

The first solution was formed by adding 324 μM of PVP (M.W. 55000) to 190 mL of glycerol, and then stirring for about one hour at about 100° C., until the PVP dissolved. After moving the first solution into a two-hole flask, the first solution was cooled to about 55° C.

Forming Second Solution

The second solution of 10 mL was manufactured by adding 46.5 μM of $AgNO_3$, 12 μM of NaCl, and 0.5 mL of pure water, to glycerol.

Forming Third Solution

The third solution was formed by adding the second solution to the two-hole flask containing the first solution.

Manufacturing Silver Nanowires

The third solution was heated from about 55° C. to about 155° C., along curve D of FIG. 1. Thereafter, the third solution was left in the two-hole flask for about 10 minutes, at about 155° C. Thereafter, a polar organic solvent, such as pure water, IPA, methanol, acetone, or the like, was mixed with the third solution.

Thereafter, silver nanowires were selectively filtered using a vacuum pump with a glass filter funnel of which a pore size was about 10 μm to about 16 μm, or about 16 μm to about 40 μm. An average diameter of the manufactured and filtered silver nanowires was about 35 nm to about 60 nm, and an average length thereof was about 70 μm to about 100 μm.

Seventh Embodiment

Forming First Solution

The first solution was formed by adding 302 μM of PVP (M.W. 55000) to 190 mL of glycerol and then stirring for about one hour at about 100° C., until the PVP dissolved. After moving the first solution into a two-hole flask, the first solution was cooled to about 55° C.

Forming Second Solution

The second solution of 10 mL was manufactured by adding 46.5 μM of $AgNO_3$, 12 of μM NaCl, and 0.5 mL of pure water, to glycerol.

Forming Third Solution

The third solution was formed by adding the second solution to the two-hole flask containing the first solution.

Manufacturing Silver Nanowires

The third solution was heated from about 55° C. to about 155° C. along curve D of FIG. 1. Thereafter, the third solution was left in the two-hole flask for about 10 minutes, at about 155° C. Thereafter, a polar organic solvent, such as pure water, IPA, methanol, acetone, or the like, was mixed with the third solution.

Thereafter, silver nanowires were selectively filtered using a vacuum pump with a glass filter funnel of which a pore size was about 10 μm to about 16 μm, or about 16 μm to about 40 μm. An average diameter of the manufactured and filtered silver nanowires was about 40 nm to about 50 nm, and an average length thereof was about 50 μm to about 70 μm.

According to the fourth to seventh embodiments, an average diameter and an average length of silver nanowires may vary by changing a mole ratio of PVP (M.W. 55000) to $AgNO_3$.

As described above, according to the one or more of the above embodiments of the present invention, silver nanowires having an aspect ratio (average length/average diameter) of 1000 or more may be manufactured.

It should be understood that the exemplary embodiments described therein should be considered in a descriptive sense only and not for purposes of limitation. Descriptions of features or aspects within each embodiment should typically be considered as available for other similar features or aspects in other embodiments.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A method of manufacturing silver nanowires, the method comprising:

forming a first solution comprising:

dissolving a dispersion stabilizer in a first polyol by stirring, while the first solution is heated at a temperature of about 90° C. to about 110° C.; and cooling the first solution to a first temperature of about 50° C. to about 60° Ca;

forming a second solution comprising a dispersion stabilizer, a silver precursor, a halogen-ion donor, deionized water, and a second polyol;

forming a third solution by mixing the second solution and the first solution;

heating the third solution to increase the temperature of the third solution from the first temperature to a second temperature, over a first time period; and forming silver nanowires by maintaining the third solution at the second temperature, wherein the temperature of the third solution is increased more rapidly during a middle portion of the first time period, as compared to beginning and end portions of the first time period.

2. The method of claim 1, wherein the first temperature is about 50° C. to about 60° C., and the second temperature is about 145° C. to about 170° C.

3. The method of claim 1, further comprising filtering the formed silver nanowires from the third solution.

4. The method of claim 3, wherein the filtering comprises using a filter having a pore size of about 10 μm to about 40 μm.

5. The method of claim 1, wherein the first time period is about 10 minutes to about 40 minutes.

6. The method of claim 5, wherein at least one of an average diameter and an average length of the silver nanowires increases in accordance with increases in the length of the first time period.

7. The method of claim 1, wherein the silver nanowires have an average diameter of from about 40 nm to about 80 nm, and have an average length of from about 20 μm to about 100 μm.

8. The method of claim 1, wherein the third solution is maintained at the second temperature for about 10 minutes to about 30 minutes, and the second temperature is about 145° C. to about 170° C.

9. The method of claim 1, wherein the first and second polyol are selected from the group consisting of ethylene glycol, propanediol, butanediol, pentanediol, hexanediol, glycerol, polyethylene glycol, and combinations thereof.

10. The method of claim 1, wherein the dispersion stabilizer is selected from the group consisting of polyvinyl pyrrolidone (PVP), polyvinyl alcohol (PVA), polyacrylamide, polyacrylic acid, poly(diallyldimethylammonium chloride) (PDADMAC), dextrin, and combinations thereof.

11. The method of claim 1, wherein the silver precursor comprises at least one of silver nitrate, silver acetate, silver chloride, silver bromide, silver iodide, and silver fluoride.

12. The method of claim 1, wherein the halogen-ion donor is selected from the group consisting of sodium chloride (NaCl), sodium bromide (NaBr), potassium chloride (KCl), potassium bromide (KBr), ammonium chloride ($NH_4Cl$), zinc chloride ($ZnCl_2$), and combinations thereof.

13. A method of manufacturing silver nanowires, the method comprising:

forming a first solution comprising a dispersion stabilizer dissolved in a first polyol by heating and then cooling the first solution to a first temperature;

forming a second solution comprising a dispersion stabilizer, a silver precursor, a halogen-ion donor, deionized water, and a second polyol;

forming a third solution comprising the second solution and the first solution;

increasing the temperature of the third solution from the first temperature to a second temperature, over a first time period; and forming silver nanowires by maintaining the third solution at the second temperature, wherein the temperature of the third solution is increased more rapidly during a middle portion of the first time period, as compared to beginning and end portions of the first time period.

14. The method of claim 13, wherein the first temperature is about 50° C. to about 60° C., and the second temperature is about 145° C. to about 170° C.

15. The method of claim 13, wherein the first time period is about 10 minutes to about 40 minutes.

16. The method of claim 13, wherein the first time period is about 10 minutes to about 40 minutes, and an average diameter and an average length of the silver nanowires increases in accordance with increases in the length of first time period.

17. The method of claim 13, further comprising filtering the silver nanowires from the third solution by using a filter having a pore size of about 10 μm to about 40 μm.

18. The method of claim 13, wherein the first and second polyols are glycerol, the dispersion stabilizer is polyvinyl pyrrolidone (PVP), the silver precursor is silver nitrate, and the halogen-ion donor is sodium chloride (NaCl).

* * * * *